United States Patent [19]

Nola

[11] 4,004,311

[45] Jan. 25, 1977

[54] HYDRAULIC LOADING AND UNLOADING DOCK

[76] Inventor: Sebastian Nola, 311 E. Empire St., San Jose, Calif. 95112

[22] Filed: Nov. 12, 1975

[21] Appl. No.: 631,060

[52] U.S. Cl. ..... 14/71.7

[51] Int. Cl.[2] ..... E01D 1/00

[58] Field of Search ..... 14/71 H, 71 R, 71 M, 14/72 R; 214/38 BA

[56] References Cited

UNITED STATES PATENTS

| | | | |
|---|---|---|---|
| 2,489,869 | 11/1949 | Dunn | 14/71 R X |
| 2,560,064 | 7/1951 | Astry | 14/71 H X |
| 2,643,010 | 6/1953 | Hott | 14/72 X |
| 2,644,971 | 7/1953 | Rowe | 14/71 H |
| 2,767,661 | 10/1956 | Tennant | 214/38 AB X |
| 2,774,492 | 12/1956 | Harrison | 14/71 H X |
| 2,798,620 | 7/1957 | Allan | 14/72 X |
| 3,004,272 | 10/1961 | Clarke | 14/72 X |
| 3,215,090 | 11/1965 | Gibbs | 214/38 AB X |
| 3,409,923 | 11/1968 | Walker | 14/71 H |

*Primary Examiner*—Nile C. Byers, Jr.

[57] ABSTRACT

A platform supported upon underground hydraulic cylinders, the platform being exchangeable with a second platform having tracks for railroad car wheels riding thereupon, the platforms thus being able to be moved vertically so that the floor of a truck trailer or a railroad car are thus brought level with the ground surface in order that a fork lift vehicle can easily travel from the ground surface into the railroad car or truck trailer.

2 Claims, 7 Drawing Figures

HYDRAULIC LOADING AND UNLOADING DOCK

This invention relates generally to freight loading and unloading docks.

A principal object of the present invention is to provide a loading and unloading dock which consists of a horizontal platform supported on hydraulic cylinders located in a bottom of a pit so that the platforms can be vertically moved whereby a truck trailer or railroad car brought upon the platform can be lowered so that the floor of the truck trailer or railroad car can be made level with the ground surface so that a fork lift traveling upon the ground can readily ride upon the trailer or railroad car floor during a loading or unloading of freight.

Another object of the present invention is to provide a loading and unloading dock which has an exchangeable platform wherein one platform is flat for trailers to ride thereupon and the other platform has rails mounted thereupon so that railroad cars can ride thereupon.

Yet another object of the present invention is to provide a loading and unloading dock which incorporates pump means within the pit so to remove precipitation therefrom.

Still a further object of the present invention is to provide a hydraulic loading and unloading dock which incorporates guide means so to align an edge of a vehicle floor with the edge of the pit prior to lowering the platform so that the floor thereof aligns with the ground level.

Other objects are to provide a hydraulic loading and unloading dock which is simple in design, inexpensive to manufacture, rugged in construction, easy to use and efficient in operation.

These and other objects will be readily upon a study of the following specification and the accompanying drawings, wherein.

Figure 1:
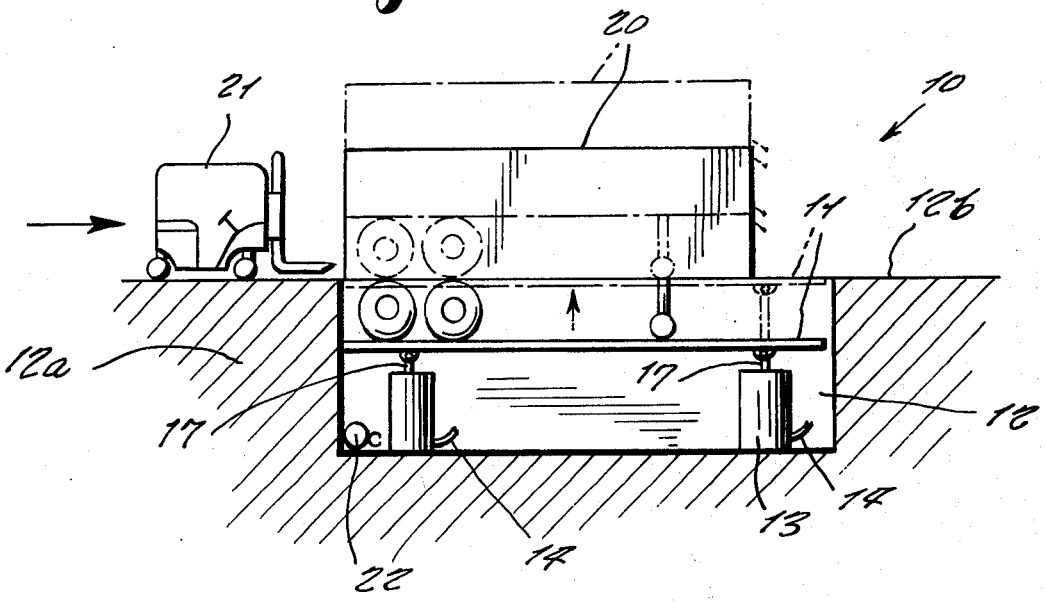
Fig. 1 is a side elevation view of the present invention showing in dotted lines a truck trailer moved thereupon while the device is at a ground level, and showing in solid lines the trailer having been lowered so that its floor is level with the ground surface.
Figure 2:
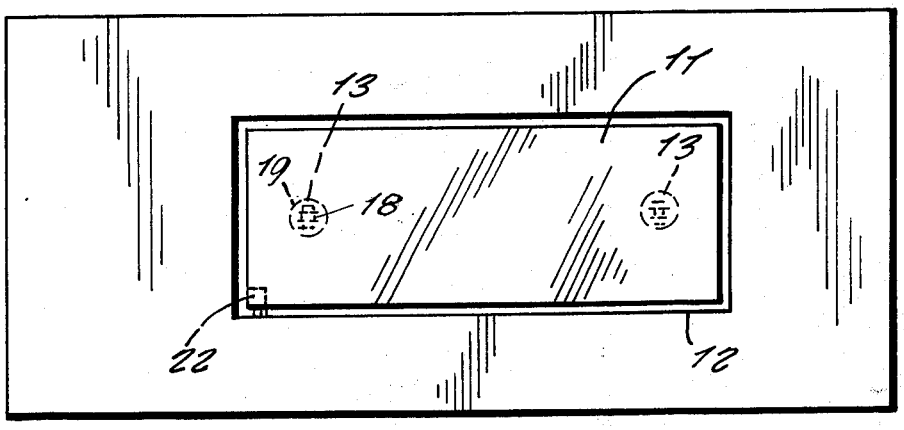
FIG. 2 is a top plan view of the invention, and showing the fork lift and trailer of FIG. 1 removed therefrom.
Figure 3:
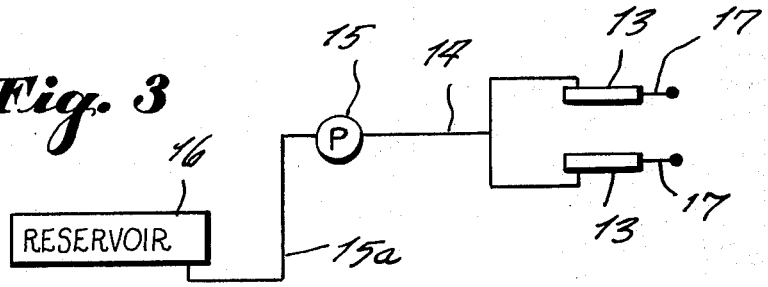
FIG. 3 is a schematic diagram of the hydraulic system of the present invention.

Reference is now made to the drawing in detail, and more particularly to FIGS. 1 through 5 thereof wherein where is a flat platform 11 which is vertically movable within a pit 12 made in a reinforced concrete 12*a*. Platform 11 is vertically movable to a ground level 12*b* by means of hydraulic cylinders 13 which are connected to hydraulic line 14 and to pump 15 connected by line 15*a* to a reservoir 16. Piston shafts 17 of hydraulic cylinders 13 are connected by means of pins 18 to mounting housings 19 which are fixedly secured to the underside of platform 11 in a suitable manner.

A trailer 20, shown in FIG. 1, is pushed upon the platform 11 by a tractor vehicle, not shown, so that when the cylinders 13 are operated, the trailer 20 can then be lowered from the position shown in phantom lines in FIG. 1 to the position shown in solid lines wherein the floor of the trailer aligns with the ground level so that a fork lift vehicle 21 can then simply travel horizontally from the ground level upon the floor of the trailer.

A pump 22 is contained within the pit 12 so as to drain any accumulated water or precipitation from the bottom of the pit 12.

Figure 4:
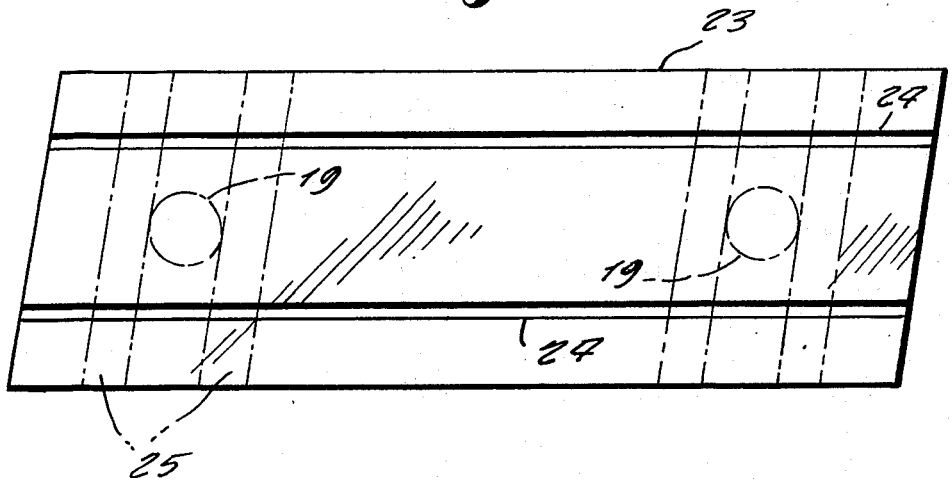
FIG. 4 is a plan view showing a modified platform for use with the device in supporting railroad cars.
Figure 5:
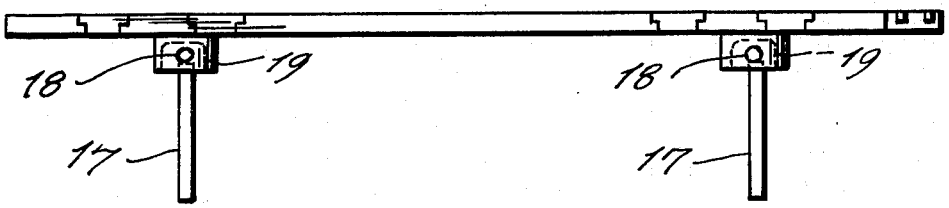
FIG. 5 is a side elevation view of the device of FIG. 1, shown fragmentarily and enlarged.

Referring now to FIGS. 4 and 5 of the drawings, a second platform 23 is exchangeable with platform 11, and being provided with parallel, spaced apart railroad tracks 24 for accommodating the wheels of a railroad car. The phantom lines 25 illustrate platform floor panels which may be made each 36 inches wide so to permit removal of these panels in order that access is available to the pit 12 in order to inspect or service the hydraulic cylinders.

When desired, platform 11 is exchangable with platform 23, by removing the shafts 18 and then replacing them again with the mounting housings 19. It should be noted that suitable stop means may be employed to limit the travel of the platforms, if so desired.

It is also to be noted that the present invention may be designed with upper and lower platforms so that they can be used in loading and unloading of live stock particularly such that is transported upon two floors of a railroad car or trailer, such as hogs and the like.

Figure 6:
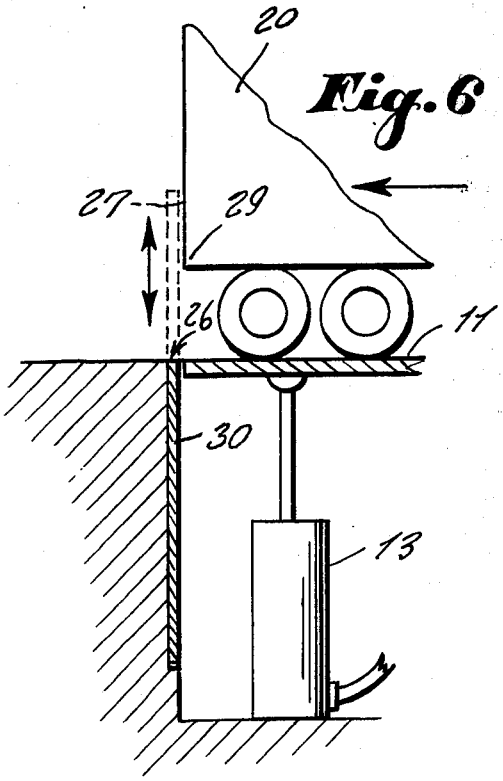
FIG. 6 is a fragmentary side elevation view similar to FIG. 1, and showing a retractable guide for aiding in alignment of a vehicle edge with an edge of a pit of the device.
Figure 7:
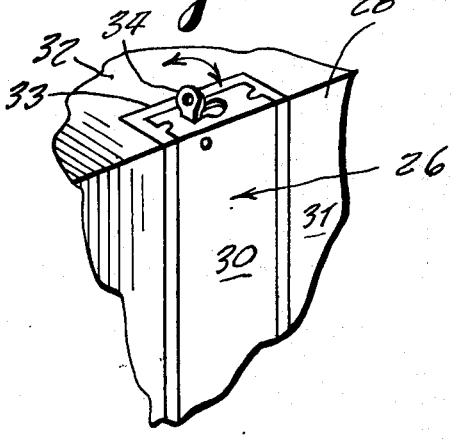
FIG. 7 is a fragmentary perspective view of the guide shown in FIG 6, and shown in retracted position.

Reference is now made to FIGS. 6 and 7 wherein there is a modified design of the invention which additionally includes a guide 26 which aids in aligning an edge 27 of a vehicle upon the platform 11 with an edge 28 of the pit so that when the platform 11 is lowered, the corner of the vehicle body as shown at 29 does not get hung up upon the corner of the pit. The guide 27 has a side 30 which is flush with the side 31 of the pit as shown in FIG. 1. The guide 27 normally is flush with the ground level 32 when not in use. However when a correct position of the vehicle is desired to be checked, the guide is simply pulled upwardly as shown by dotted lines in FIG. 6 and if the vehicle clears the guide, the vehicle will then clear the edge of the pit. A track 33 is embedded within the ground and the guide slides within the track. An upwardly pivotable finger pull 34 provides easy grasy of the guide so to pull the same upwardly.

While various changes may be made in the detail construction, it is understood that such changes will be within the spirit and scope of the present invention as is defined by the appended claims.

What I claim is:

1. A hydraulic loading and unloading dock, comprising in combination, an open pit formed within a reinforced concrete, a pair of hydraulic cylinders mounted upon a bottom of said pit, a horizontal platform supported upon said hydraulic cylinders, said platform being vertically movable within said pit and up to an upper edge of said pit; said platform being exchangeable with a second platform, the first said platform being adaptable for truck trailers to ride thereupon, and said second platform being provided with rails for railroad cars to travel thereupon; each said platform having a plurality of transverse panels removable from said platform so as to allow access from above down into said pit therebeneath, mounting housings being fixedly secured to an underside of said platforms, said mounting housings being connected by shafts to the upper end of piston shafts of said hydraulic cylinders; and a vertically upwardly slideable guide being supported in a vertical track along one end edge of said pit for insurance of a vehicle upon said platforms clearing an edge of said pit when being downwardly lowered into said pit; said guide side being flush with a side wall of said pit.

2. The combination as set forth in Claim 1, wherein an upper end of said guide is flush with said upper edge of said pit when in downwardly slided away position.

* * * * *